United States Patent [19]

Warwicker

[11] 4,276,000

[45] Jun. 30, 1981

[54] LIQUID FUEL PUMPING APPARATUS

[75] Inventor: Peter G. Warwicker, Longleavens, England

[73] Assignee: Lucas Industries Limited, Birmingham, England

[21] Appl. No.: 974,041

[22] Filed: Dec. 28, 1978

[30] Foreign Application Priority Data

Jan. 31, 1978 [GB] United Kingdom ..... 3772/78

[51] Int. Cl.[3] ..... F04B 49/06; F02M 39/00; F02D 5/02

[52] U.S. Cl. ..... 417/302; 123/499

[58] Field of Search ..... 417/302, 303; 123/139 F, 139 AB, 140 A, 139 AE; 139/338, 499

[56] References Cited

U.S. PATENT DOCUMENTS

| | | | |
|---|---|---|---|
| 654,140 | 7/1900 | Diesel | 123/140 A |
| 4,029,071 | 6/1977 | Saito et al. | 123/139 AB |

FOREIGN PATENT DOCUMENTS

| | | | |
|---|---|---|---|
| 2137832 | 2/1972 | Fed. Rep. of Germany | 123/139 AB |
| 547969 | 10/1922 | France | 123/140 A |
| 311643 | 5/1929 | United Kingdom | 123/139 E |

*Primary Examiner*—Richard E. Gluck

[57] ABSTRACT

A fuel pumping apparatus comprises a pump barrel which defines a bore accommodating a reciprocable plunger. The housing part is provided which is held in sealing engagement with the barrel and in which there is formed a first passage through which fuel flows from the pumping chamber defined in part by the bore, to an outlet and a second passage formed in the housing part and through which fuel can be spilled from the pumping chamber under the control of a valve means including a valve member slidable within a bore. No ports or grooves are formed on the pumping plunger at its end which defines a wall of the pumping chamber.

6 Claims, 9 Drawing Figures

LIQUID FUEL PUMPING APPARATUS

This invention relates to liquid fuel pumping apparatus for supplying fuel to an internal combustion engine and of the kind comprising a pump barrel defining a bore, a pumping plunger movable within the bore, resilient means biasing the plunger in an outwards direction, tappet means engaged with the outer end of the plunger and engageable in use, with a cam which effects inward movement of the plunger, an outlet in communication with the bore for connection in use to an injection nozzle of the engine, and means for spilling fuel during the inward movement of the plunger to determine the amount of fuel supplied through said outlet.

In known forms of such apparatus the spilling of fuel has been obtained by uncovering a spill port formed in the wall of the bore, to a groove or the like formed in the plunger and communicating with the end of the bore remote from the tappet. The groove has an inclined control edge whereby the amount of fuel spilled can be determined by adjusting the relative angular setting of the plunger and the barrel. This form of construction is widely used in the fuel pump art, but it does have a number of inherent problems which can prove very difficult to overcome particularly where the apparatus is required to provide a high delivery pressure.

In order to satisfy more stringent regulations regarding fuel consumption and the reduction of noxious gases in the engine exhaust to name but two, it is necessary to reduce the injection period, that is to say the period during which fuel is delivered to the engine. However, the outlet orifices in the injection nozzles through which the fuel flows into the combustion spaces of the engine are carefully sized and positioned to cater for all the working conditions of the engine and the only practical way of reducing the injection period is to increase the pressure at which fuel is supplied to the injection nozzles.

The pressure of fuel upstream of the outlet orifices of the injection nozzles in existing engines of the kind under consideration is between 700 and 1100 Ats (Atmospheres). In order to satisfy the more stringent regulations it is envisaged that the pressure will have to lie in the range 1200–2000 Ats.

Various problems arise with the conventional form of pumping apparatus described when the pressure in the pumping chamber exceeds 800 Ats. For example, asymetrical distortion of the pump barrel, stress concentrations caused by the provision of the port and helix, leakage caused by the decreasing length of the leakage path as the plunger movement takes place and by the distortion of the barrel. The distortion itself can lead to seizure. Side loading of the plunger can occur but this can be reduced by providing a pair of helices. This in turn, however, tends to increase the leakage. There is also the problem of providing linkage to move the plunger angularly to vary the quantity of fuel supplied by the apparatus and where a number of plungers are provided in respective barrels, there is the problem of ensuring that the delivery of fuel from the pumping chambers takes place at the correct time, and the problem of ensuring that equal volumes of fuel are delivered by each plunger/barrel combination.

The object of the invention is to provide an apparatus of the kind specified in a form in which it is better able to deliver fuel at the high pressures mentioned.

According to the invention an apparatus of the kind specified comprises a housing part which is held in sealing engagement with the end of the barrel remote from the tappet means, a first passage formed in said housing part, said first passage constituting the outlet from the bore, a second passage in the housing part and valve means operable to control fuel flow out of said bore through said second passage.

Figure 1:
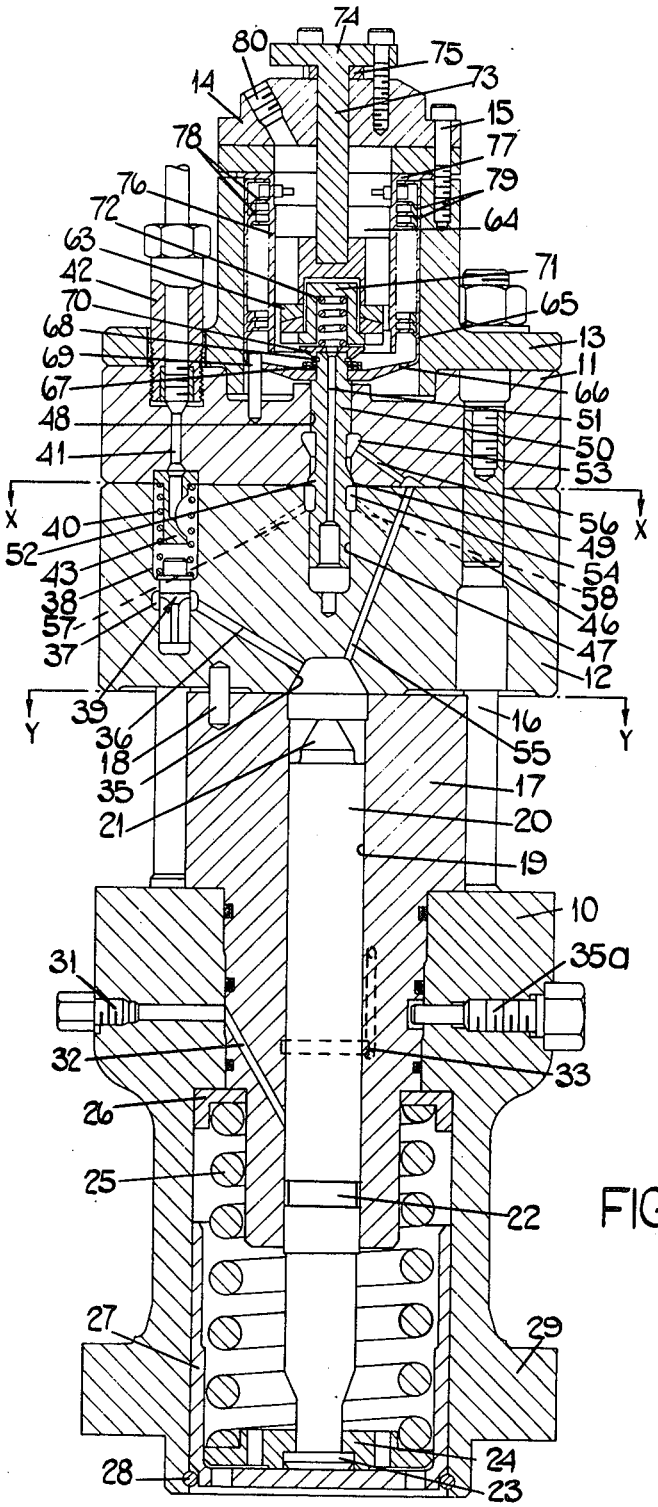
FIG. 1 is a sectional side elevation of one example of the apparatus.

Referring to FIG. 1 of the drawings the apparatus comprises a multi-part housing comprising a base portion, 10, valve locating portions 11 and 12 and a cap portion 13, the cap portion 13 also having an upper closure portion 14 secured thereto by means of a plurality of bolts 15.

Figure 2:
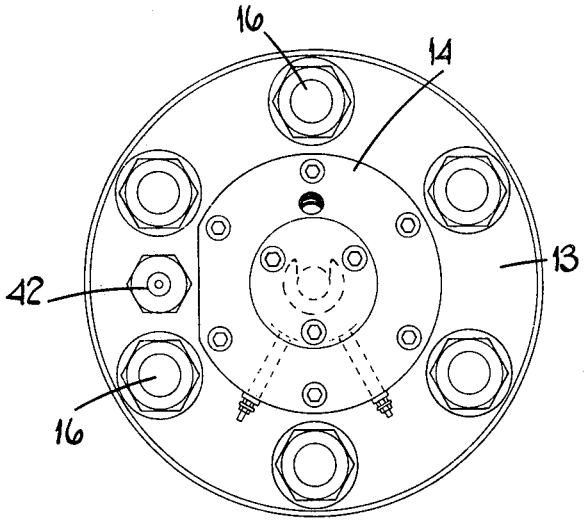
FIG. 2 is a plan view of the apparatus.

The portions 13, 11, 12 and 10 are secured together by studs and nuts 16, six of which are provided as shown in FIG. 2.

Located between the portions 10 and 12 of the housing is a pump barrel 17 which is of stepped construction and which has a reduced portion extending within the base portion 10. The barrel defines a flange which is positioned between the portions 10 and 12 and the face of the portion 12 which is presented to the flange, is relieved so as to provide sufficient sealing force to withstand the high pressure. The force exerted on the barrel is such as to cause inward distortion of the plunger bore 19 formed in the pump barrel and the upper end portion of the bore is provided with a relief to accommodate any distortion. Moreover, dowels 18 are provided to position the pump barrel and portion 12 relative to each other.

Formed within the barrel is a cylindrical bore 19 and located within the bore is a pumping plunger 20. Contrary to usual practice with fuel pumping apparatus, the plunger 20 does not have any passages or grooves within it or on its peripheral surface but it is provided with a projection 21 at its inner end and a circumferential groove 22 adjacent its outer end. The projection 21 acts to reduce the dead volume in the pumping chamber.

The plunger 20 extends from the barrel and its outer end defines a head 23 which is engaged by a spring abutment 24. The abutment locates one end of a coiled compression spring 25 the other end of which bears against a further spring abutment 26 which is located against a step defined in the base portion 10. Moreover, slidable within the base portion and surrounding part of the spring 25 is a tappet 27 this being prevented from falling out of the base portion by means of a circlip 28. In use, the tappet is engaged by a cam which effects inward movement of the plunger 20 against the action of the spring 25. Outward movement of the tappet and the plunger is effected by the spring 25 as the cam rotates.

The base portion is provided with a flange 29 in which is formed a plurality of apertures 30 which in use, receive securing bolts whereby the apparatus can be secured to a part of the engine structure.

Figure 3:
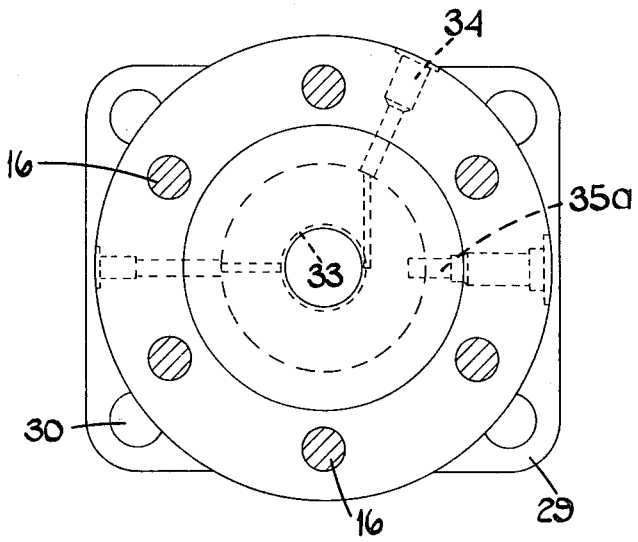
FIGS. 3 and 4 are sectional view on the line Y—Y and X—X of FIG. 1.

The base portion also defines an inlet 31 for lubricating oil and which communicates with a passage 32 formed in the barrel and which periodically is brought into register with the circumferential groove 22. Moreover, the bore 19 is provided with a circumferential groove 33 well removed from the inner end of the bore, and which communicates as shown in FIG. 3, with an outlet 34. In use, the outlet 34 is connected to a drain and it serves to convey away from the apparatus any fuel which has managed to leak between the working clearance defined between the plunger 20 and the bore 19. Finally the base portion also mounts a locating peg 35*a* which is engageable within a recess formed in the pump barrel so as to position and retain the barrel within the base portion.

Within the valve locating portion 12 there is defined a recess 35 which is aligned with the bore 19 and therefore serves to close the end of the bore. The recess 35 receives when the plunger is moved inwardly, the projection 21 formed on the end of the plunger and communicating with the recess is a first passage 36 through which fuel is displaced from the bore 19 during the inward movement of the plunger 20. The passage 36 at its other end, communicates with a circumferential groove 37 which is formed about the narrower portion of a bore 38. The step between the narrower and wider portions of the bore 38 constitutes a seating for the head of a delivery valve element 39. The valve element 39 is located by means of a coiled compression spring 40 so that the head is urged into contact with the seating. As shown in FIG. 1 the delivery valve element is of conventional design with an unloading collar disposed adjacent the head and the remaining portion of the valve element is fluted. In use, fuel under pressure flowing through the passage 36 acts on the valve element to move the element against the action of the spring 40 thereby to initially displace fuel from the wider portion of the bore 38 and when the unloading collar is moved beyond the end of the narrower portion of the bore, to cause fuel flow through the wider portion of the bore 38. The wider portion of the bore 38 communicates with a passage 41 which is formed in the valve locating portion 11 of the housing, the passage 41 being enlarged and provided with a screw thread to receive an outlet union indicated at 42. The union 42 passes with clearance through an aperture formed in the cap portion 13. A stop member 43 is provided to limit the extent of movement of the delivery valve element.

Figure 4:
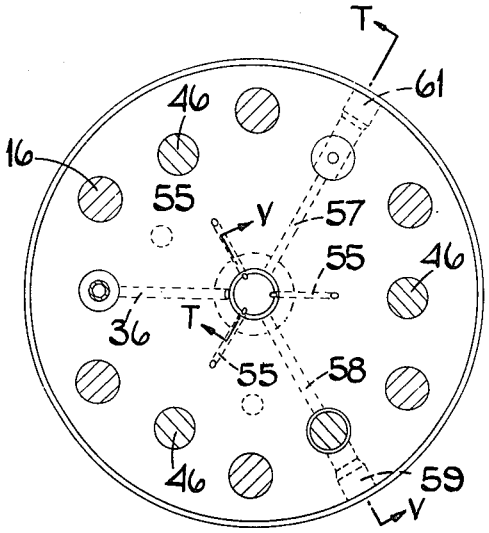

Dowels indicated at 46 (FIG. 4) are provided between the two portions and these are inserted during assembly of the complete apparatus and are intended to hold the two portions in their correct relationship during tightening of the through bolts.

Figure 5:
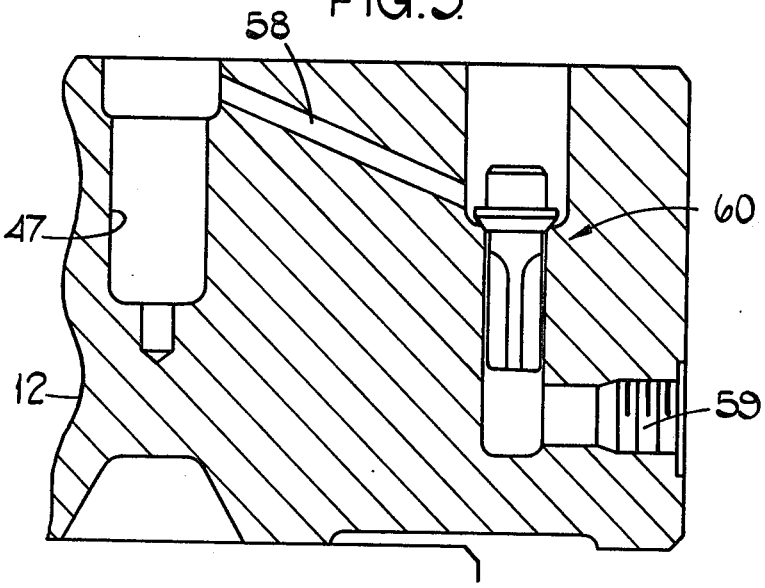
FIG. 5 is a scrap sectional view on the lines V—V of FIG. 4.
Figure 6:
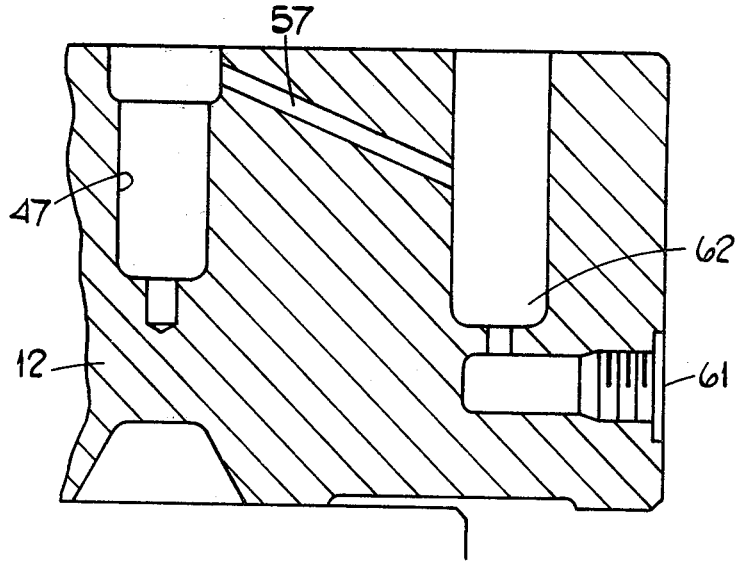
FIG. 6 is a scrap sectional view on the line T—T of FIG. 4.
Figure 7:
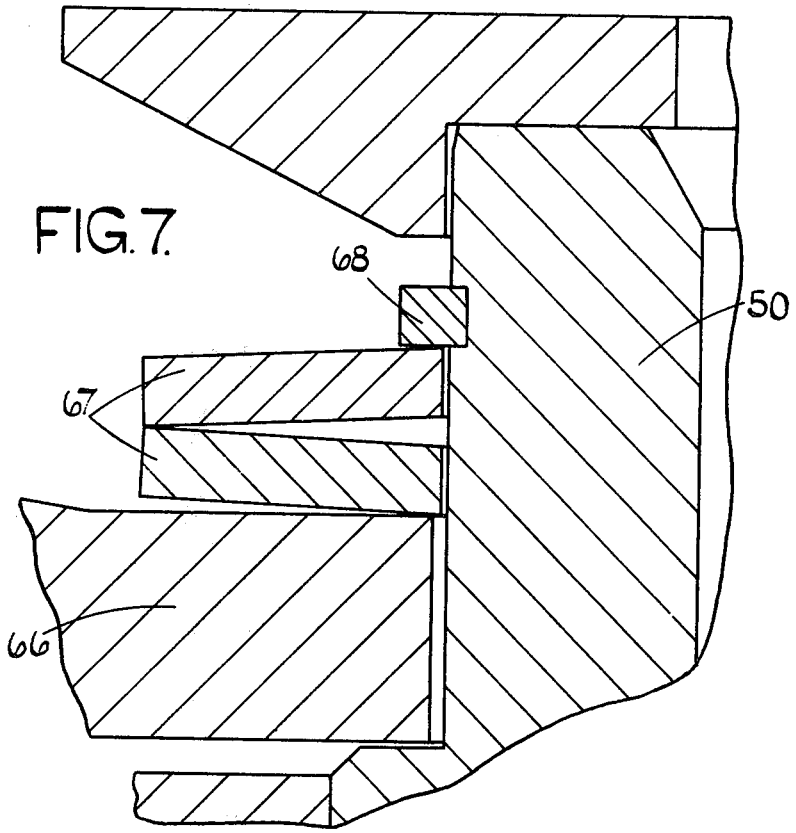
FIG. 7 is a view to an enlarged scale of a part of the apparatus of FIG. 1.

Extending within the valve locating portion 12 and from the face thereof which is adjacent the portion 11 is a blind bore 47 which is enlarged at its end adjacent the portion 11. Moreover, extending within the portion 11 is a cylindrical bore 48 and axes of the bores 47 and 48 being coincident and their diameters being the same. The bore 48 also has an enlargement intermediate its ends and at its end adjacent the portion 12 is machined to define a seating 49. Slidable within the bores 47 and 48 is a cylindrical valve member 50 which has a drilling 51 extending between its ends. The valve member 50 has a slightly enlarged intermediate portion intermediate its ends to define what can be termed a head 52. On opposite sides of the head the valve member 50 is of reduced diameter so as to define with the aforesaid enlargement within the bores 47 and 48, a pair of spaced chambers 53, 54. The head 52 is machined so as to form a fluid tight seal in the closed position of the valve member, with the seating 49 the effective diameter of which is equal to the diameters of the bores 47, 48. Moreover, extending from the chamber 35 are passages 55 which communicate by way of co-operating passages 56, with the aforesaid chamber 53. Moreover, communicating with the aforesaid chamber 54 is a pair of passages 57, 58. Passage 58 communicates with a fuel inlet 59 formed in the valve locating portion 12 of the housing. As shown in FIG. 5 the passage 58 does not communicate directly with the inlet 59 but with the inlet by way of a non-return valve 60. This valve is protected from the pressure within the pumping chamber by the valve 50. The construction of the valve 60 is conventional so far as non-return valves are concerned, the valve member forming the valve being provided with a head which co-operates with the seating. In addition although not shown in FIG. 5, a coiled compression spring is provided to load the head into engagement with the seating. The purpose of the valve as will be explained, is to prevent fuel which is spilled from the bore passing to the inlet 59. The passage 57 communicates with an outlet 61 formed in the portion 12 and shown more clearly in FIG. 6. In FIG. 6 it will be noted that the passage 57 communicates with the spill outlet 61 by way of a chamber 62. This chamber may contain a further valve disposed to permit the spillage of fuel through the outlet 61 but preventing flow of fuel in the opposite direction or it may contain an orifice to control the rate of spillage of fuel.

Returning to FIG. 1 the valve member 50 extends into a chamber 64 which is defined in the cap portion 13. The wall of the chamber 64 is of cylindrical form and serves as a bearing surface for an annular armature of cup shaped form. The annular wall of the armature is referenced 65 in FIG. 1 and the base wall 66. The base wall is provided with a central aperture through which extends a reduced portion of the valve member 50 the latter defining a step and the base wall 66 of the armature being urged towards the step by means of resilient means in the form of a pair of dished springs 67. These are retained on the valve member 50 by means of a circlip 68. An enlarged view of this construction is seen in the modification of the apparatus shown in FIG. 8. The armature is prevented from moving angularly by means of a pin 69 which extends through an aperture in the base wall 66 and is located in the portion 11 of the housing.

The end of the valve member is provided with a member 70 which defines a surface presented to a complementary surface formed at the end of a top hat section member 71. In the example these surfaces are flat but could be curved if desired. The member 71 accommodates a coiled compression spring 72 which acts on the member 70 in a direction to urge the head 52 of the valve member away from the seating 49.

The member 71 is located in position by means of a pin 73 having a head 74 which is secured to the upper closure portion 14. Moreover, interposed between the head 74 and the closure portion 14 is a spacer 75 by which the clearance between the aforesaid surfaces on the members 70 and 71 when the valve is in the closed position, can be adjusted. Moreover, the member 71 is located by a spherical seat assembly 63 which allows automatic alignment of the surfaces of the members 70 and 71.

Located within the armature 65 is a winding structure which comprises an annular member 76 having an outwardly extending flange 77 at its upper end, the flange being trapped between the upper closure portion 14 and the cap portion 13.

On the external peripheral surface of the annular member 76 is formed at least one pair of helical grooves. The formation of the grooves results in the creation of a pair of helically extending spaced ribs 78. The grooves which define the ribs 78 are provided with windings, the winding arrangement being such that in the case where only one pair of grooves is provided, the direction of current flow in the windings in the grooves is in the opposite direction. Where more than one pair of grooves is provided then the winding arrangement is such that the direction of current flow in adjacent grooves is in the opposite direction. Thus when the windings are supplied with electric current, the projections 78 will be polarised to opposite magnetic polarity.

On the internal peripheral surface of the armature 65 is formed in the case where there are two grooves on the member 76, a pair of helically disposed projections 79. In the de-energised state of the windings the projections 79 are axially spaced from the projections 78 but when the windings are energised, the projections 79 move towards the projections 78 under the action of the magnetic field. In so doing the valve member 50 is moved against the action of the spring 72 so that the head portion of the valve 50 moves into contact with the seating 49. For a more comprehensive description of the electromagnetic device, reference can be made to the specification of British Pat. No. 1,504,873.

It will be noted from FIG. 1 that the upper closure portion 14 is provided with a fuel passage 80 which in use, would be connected to a drain. This passage allows any fuel leaking past the valve member 50 into the chamber 64 to be conducted away from the apparatus. It should be noted however, that the chamber 64 will normally be filled with fuel for a reason which will become apparent in due course.

In operation, it will be appreciated that when the valve 50 is in the closed position as shown in FIG. 1, then upward movement of the plunger will cause displacement of fuel from the bore 19 through the passage 36, past the delivery valve 39 to the associated engine. If during the upward movement of the plunger the valve 50 is moved to the open position, then the delivery valve will shut quickly because of the high force exerted by the spring 40 and the remaining quantity of fuel which is displaced from the bore 19 will flow by way of the passage 57 and the outlet 61 to a convenient drain. The rate of spill will be controlled if an orifice is present in the chamber 62. It will be appreciated that the amount of fuel which is delivered to the engine can be controlled by varying during the inward movement of the plunger, the distance the plunger moves with the valve in the closed position. Moreover, within limits depending upon the amount of fuel which is delivered by the plunger, the timing of the delivery of fuel can also be controlled. For example, if it is required to advance the timing of injection then the valve 50 will be closed earlier during the inward movement and if it is required to retard the timing of delivery of fuel then the valve will be closed later during the inward movement of the plunger. In practice it is arranged that a small quantity of fuel is always spilled from the bore 19 at the start of the inward movement of the plunger. It should be noted that because of the valve 60, the fuel which is spilled does not flow to the external source of fuel which is connected to the inlet 59. This external source may comprise a pump driven by the associated engine and it may have its outlet pressure controlled.

During outward movement of the plunger 20 mainly under the action of the spring 25, the valve 50 will be retained in the open position and during this time fuel will flow past the valve 60 into the chamber 54 through the passages 56 and 55 to the bore 19. The bore 19 is thus completely filled with fuel and in fact the pressure of fuel which is supplied through the inlet 59 will assist the downward movement of the plunger 20. In addition the flow through the inlet is always in excess so that fuel will flow through the outlet. This flow of fuel provides for cooling and air venting.

It has already been mentioned that when the windings are energised, the valve member is moved to the closed position. The armature has a considerable mass and since it moves very quickly when the windings are energised, if it were directly connected to the valve member 50 it is possible that damage would occur to the valve member and/or seating 49. Such damage is minimised by the presence of the dished springs 67. The action of the springs is to permit, once the valve member 50 has been halted by contact of the head 52 and seating 49, the continued movement of the armature until the projections 78 and 79 engage each other. Thus the risk of damage to the valve head and the seating is minimised. Moreover, damping of the movement of the valve member 50 is obtained by virtue of the fact that when the valve member 50 is being moved upwardly there is a flow of fuel into the lower end of the bore 47 which accommodates the valve member. This flow of fuel takes place through the drilling 51 which extends through the valve member and fuel flow through this drilling flows between the annular space defined between the opposed surfaces on the members 70 and 71. As the valve member moves upwardly therefore the space constitutes a restriction to the flow of fuel which restriction increases as the valve member moves towards the closed position. Thus damping of the valve member is provided.

When the windings are de-energised the valve member 50 is moved to the open position by the action of the springs 72. In addition the energy stored in the springs 67 accelerates the armature and this energy is imparted to the valve member when the base wall 66 engages the shoulder on the valve member.

As shown the delivery valve 39 is fast acting because there is no substantial hinderance to the return flow of fuel from the narrower end of the bore 38 through the passage 36. Hence as soon as the pressure in the bore 19 is lowered by spillage of fuel, the delivery valve will move to its closed position. It is perfectly feasible to employ a delivery valve the valve member of which and the surrounding bore define a dash-pot thereby restricting the rate of closure of the valve and minimising the creation of shock waves in the pipeline interconnecting the apparatus and the injection nozzle.

Control of the rate of spillage of fuel from the bore 19 can be obtained by controlling the size of the passage 57. Clearly the passage itself constitutes a restriction to the flow of fuel but if it is made of a small diameter increased restriction of the flow of fuel can be arranged and this will reduce the rate of spillage of fuel. As explained it is possible to employ a restrictor in the chamber 62 alternatively a special valve may be located in the chamber 62. In this case the valve is not a non-return valve in the strict sense of the term but has a valve element movable in response to the pressure drop across an orifice through which the spilled fuel flows, the valve member moving to restrict flow of fuel through a further orifice if the rate of spill exceeds a predetermined value.

In the present example the valve 50 protects the inlet valve 60 from the high pressure attained during injection of fuel. It will be understood that this need not be the case. The valve 60 can be designed to withstand the high pressure achieved during delivery of fuel and therefore can be directly connected by a drilling to the recess 35.

The apparatus as described avoids the need to provide a port or ports in the wall of the barrel and co-operating grooves in the plunger. The barrel is therefore subject to a uniform stress and the side loading on the plunger is also uniform. Moreover, the leakage path for the high pressure fuel whilst it does reduce in length as the delivery of fuel proceeds it is nevertheless of much greater length than if the plunger were provided with grooves.

Figure 8:
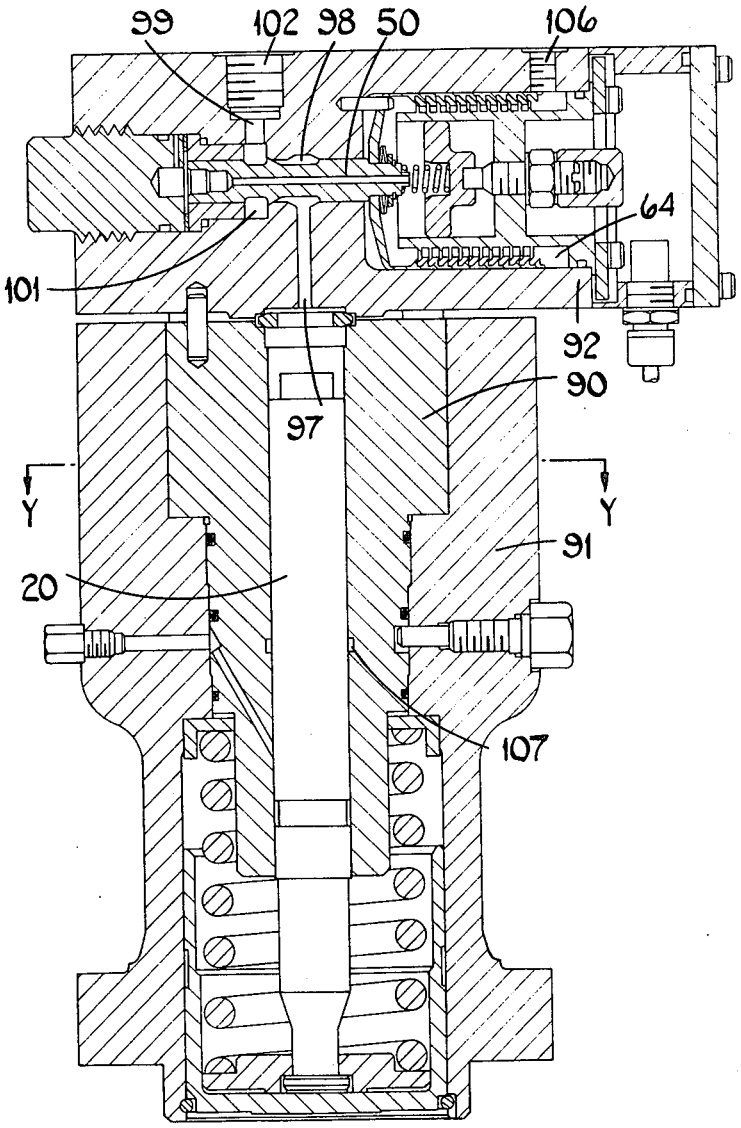
FIG. 8 is a view similar to FIG. 1 showing a modification and FIG. 9 is a plan view of the example shown in FIG. 8.
Figure 9:
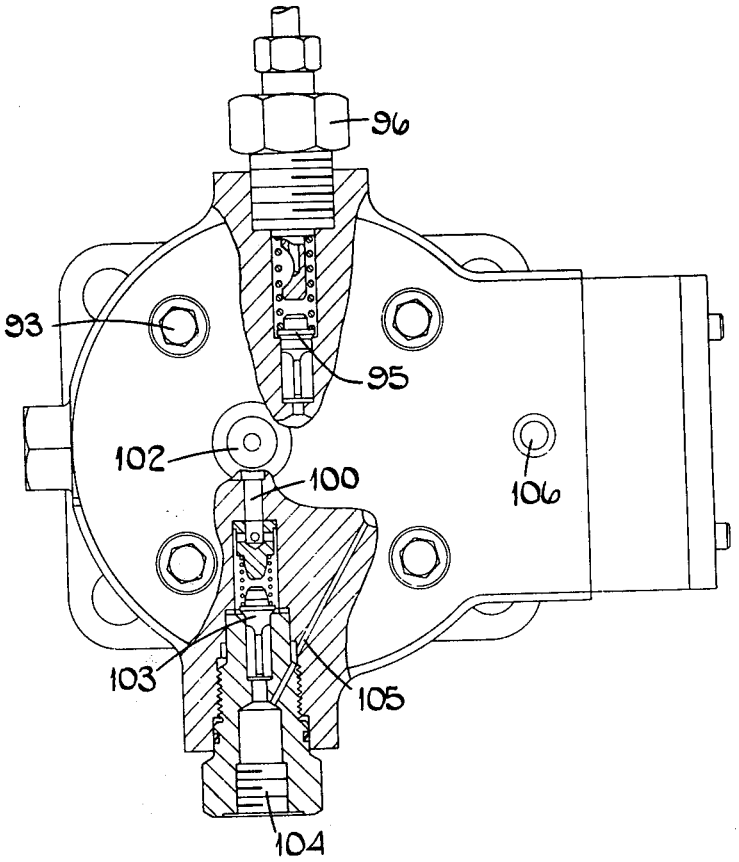

A modified construction is shown in FIGS. 8 and 9. With reference to these Figures the pump barrel is indicated at 90 and it is located in a surrounding housing portion 91. A valve housing portion 92 is provided and this is relieved so that it engages only with the end of the barrel. The valve housing portion is secured to the housing portion 91 by bolts 93 and dowels may be provided to ensure accurate location.

A delivery valve 95 is provided in the housing portion 92 and a spring is provided in a chamber formed in the housing portion to urge the head of the delivery valve into contact with a seating. An outlet 96 communicates with the aforesaid chamber which also accommodates a stop member to limit the movement of the valve. The axis of movement of the delivery valve is at right angles to that of the bore in the barrel which contains the pumping plunger.

Formed in the valve housing portion 92 is a passage 97 which leads from the pumping chamber defined by the plunger, the wall of the bore in the barrel in which the plunger is located and the face of the valve housing portion to a chamber 98 which corresponds to the chamber 53 in the example of FIG. 1. The valve member 50 in this example is disposed at right angles to the axis of the bore in the barrel.

Extending from a chamber 101 and as seen in FIG. 8 is a passage 99. The chamber 101 is the equivalent of the chamber 54 in the example of FIG. 1. The passage 99 terminates in a spill outlet 102 which may incorporate an orifice to control the rate of spillage of fuel when the valve member 50 is moved to its alternative position. Also communicating with the chamber 101 is a passage 100 (FIG. 9) through which fuel is supplied to the pumping chamber. The passage 100 contains a simple non-return valve 103. As with the previous example the pressure of fuel supplied to an inlet 104 upstream of the valve 103 is such that the valve is held in the open position at all times except when fuel is being spilled from the pumping chamber. This flow of fuel provides for cooling of the apparatus.

A further flow of fuel for cooling purposes takes place along a passage 105 to the chamber 64 which accommodates the electro-mechanical actuator for the valve 50. The passage 105 communicates directly with the fuel inlet 104 and fuel leaves the chamber 64 by way of an outlet 106. Leakage fuel which flows past the plunger 20 is also allowed to escape through the outlet 106. This fuel is collected in a groove 107 in the wall of the plunger bore 19 and flows by way of co-operating passages (not shown) in the barrel, and the two housing parts to the chamber 64.

I claim:

1. A liquid fuel pumping apparatus for supplying fuel to an internal combustion engine comprising a pump barrel defining a bore, a pumping plunger movable within the bore, resilient means biasing the plunger in an outward direction, tappet means engaged with the outer end of the plunger and engageable in use with a cam which imparts inward movement to the plunger, an outlet in communication with the bore for connection in use to an injection nozzle of the associated engine, a housing part which is held in sealing engagement with the end of the barrel remote from the tappet means, a first passage formed in said housing part, said first passage constituting the outlet from the bore, a second passage formed in the housing part, valve means operable to control fuel flow through said second passage, a fuel inlet in said housing portion, and a third passage connected to said inlet and communicating with said second passage on the side of said valve means remote from the bore, whereby said valve means controls the flow of fuel to the bore from said inlet, and a non-return valve in said third passage, said valve means comprising a valve member slidable within a second bore, resilient means biasing the valve member to an open position, and electromagnetic means operable to move said valve member to a closed position, said valve member being of cylindrical form having a head portion defined intermediate its ends, a seating defined in said second bore and a pair of chambers defined between the valve member and the second bore on opposite sides of the seating respectively, one of said chambers communicating with the bore containing the plunger and the other chamber communicating with the second and third passages, communication between said chambers being controlled by the valve member.

2. An apparatus according to claim 1 including passage means extending between the ends of the second bore containing the valve member and through which fuel flows during displacement of the valve member by the resilient means and electromagnetic means.

3. An apparatus according to claim 2 including means for restricting the flow of fuel through said passage means to cushion the movement of the valve member into contact with the seating.

4. An apparatus according to claim 3 in which said passage means extends between the ends of the valve member one end of said valve member mounting a member having a face presented to the open end of a top hat section cup shaped member, said resilient means being in the form of a coiled compression spring located within said cup shaped member and acting on the valve member through said member, said passage means extending through said member, the presented faces of said cup shaped member and said member constituting an increasing resistance to the flow of liquid through said passage means as the valve head moves into contact with the seating.

5. An apparatus according to claim 2 in which the axis of the second bore containing the valve member is parallel to the axis of the bore containing the plunger.

6. An apparatus according to claim 2 in which the axis of the second bore containing the valve member is substantially at right angles to the axis of the bore containing the plunger.

* * * * *